US007804458B2

(12) United States Patent
Montgomery et al.

(10) Patent No.: US 7,804,458 B2
(45) Date of Patent: Sep. 28, 2010

(54) SLOT ANTENNA

(75) Inventors: Mark Montgomery, Melbourne Beach, FL (US); Frank M. Caimi, Vero Beach, FL (US)

(73) Assignee: SkyCross, Inc., Melbourne, FL (US)

( * ) Notice: Subject to any disclaimer, the term of this patent is extended or adjusted under 35 U.S.C. 154(b) by 147 days.

(21) Appl. No.: 12/055,259

(22) Filed: Mar. 25, 2008

(65) Prior Publication Data

US 2008/0231522 A1 Sep. 25, 2008

Related U.S. Application Data

(60) Provisional application No. 60/896,930, filed on Mar. 25, 2007.

(51) Int. Cl.
*H01Q 13/10* (2006.01)
*H01Q 1/24* (2006.01)

(52) U.S. Cl. ..... 343/767; 343/702

(58) Field of Classification Search ..... 343/767, 343/770, 702, 700 MS
See application file for complete search history.

(56) References Cited

U.S. PATENT DOCUMENTS 3,852,994 A * 12/1974 Pereda ..... 73/35.15
4,328,502 A * 5/1982 Scharp ..... 343/771
5,489,913 A * 2/1996 Raguenet et al. ..... 343/767
5,955,997 A 9/1999 Ho
6,636,181 B2 * 10/2003 Asano et al. ..... 343/702
7,079,081 B2 7/2006 Parsche
2007/0194994 A1 * 8/2007 Waltho ..... 343/702

* cited by examiner

*Primary Examiner*—Hoang V Nguyen
(74) *Attorney, Agent, or Firm*—John L. DeAngelis; Beusse Wolter Sanks Mora & Maire, P.A.

(57) ABSTRACT

A communications device for sending and receiving an information signal. The communications device comprising an element having an opening defined therein for receiving an antenna, the element comprising first conductive material disposed proximate the opening and comprising transmitting and receiving circuits. The antenna comprises: a dielectric tubular member, second conductive material forming an exterior surface of the tubular member with the second conductive material defining a slot therein, a slot length approximately equal to one-half of a guided wavelength and a feed connected to the transmitting and receiving circuits and disposed proximate the slot for establishing currents in the second conductive material.

17 Claims, 2 Drawing Sheets

SLOT ANTENNA

REFERENCE TO RELATED APPLICATIONS

This application claims the benefit, under 35 U.S.C. 119 (e), of the provisional patent application entitled Slot Antenna filed on Mar. 25, 2007 and assigned application No. 60/896,930.

FIELD OF THE INVENTION

The present invention is related generally to antennas for wireless communications devices and specifically to slot antennas.

BACKGROUND OF THE INVENTION

It is known that antenna performance is dependent on the size, shape and material composition of the antenna elements, the interaction between elements and the relationship between certain antenna physical parameters (e.g., length for a linear antenna and diameter for a loop antenna) and a wavelength of the signal received or transmitted by the antenna. These physical and electrical characteristics determine several antenna operational parameters, including input impedance, gain, directivity, signal polarization, resonant frequency, bandwidth and radiation pattern. Since the antenna is an integral element of a signal receive and transmit path of a communications device, antenna performance directly affects device performance.

Generally, an operable antenna should have a minimum physical antenna dimension on the order of a half wavelength (or a multiple thereof) of the operating frequency to limit energy dissipated in resistive losses and maximize transmitted or received energy. Due to the effect of a ground plane image, a quarter wavelength antenna (or odd integer multiples thereof) operative above a ground plane exhibits properties similar to a half wavelength antenna.

Communications device product designers prefer an efficient antenna that is capable of wide bandwidth and/or multiple frequency band operation, electrically matched (e.g., impedance matched) to the transmitting and receiving components of the communications system and operable in multiple modes (e.g., selectable signal polarizations and selectable radiation patterns). They also prefer a physically small antenna.

Consumer communications devices or devices incorporating a communications component, such as portable notebook computers, include antennas for various wireless communications services such as WLAN, WiMAX and cellular services. Due to the requirements for form and functionality, the physical space available for the antenna(s) is typically limited to narrow spaces close to and/or between conductive objects. But conventional antenna design approaches, such as PIFA-type antennas, work poorly in circumstances where the antenna is disposed in a narrow opening or gap (e.g., less than about 1/10 wavelength) between conductive objects. For example when the antenna is to be mounted between the display and keyboard portions of a notebook computer. Large areas of the screen and the keyboard are made from conductive metal, and the space between the two is effectively a long narrow gap between large conductive bodies. It appears that the geometric constraints of this antenna location allow effective propagation of only those modes with electric-field polarization across the gap (e.g., across the smaller dimension of the gap or between an edge of the screen and an adjacent edge of the keyboard). Commonly used antennas that work well in unbounded conditions, such as PIFA type antennas, may perform poorly when installed in the aforementioned gap location because of the electromagnetic constraints of the gap.

A slot antenna may consist of a conductive surface, usually a flat plate, with a hole or slot formed in the plate. The slot may be fed by connecting antenna feed conductors across the slot. For example, a coaxial cable shield is connected to a first edge of the slot (or bonded to the plate) while a center conductor is connected to a second slot edge (parallel to the first edge). Supplying a driving frequency between the coaxial cable shield and the center conductor, causes the slot antenna to radiate electromagnetic waves similar to a dipole antenna. The shape and size of the slot and the driving frequency determine the radiation pattern.

Slotted cylindrical antennas are known as first described by Andrew Alford in 1946 and discussed by John D. Kraus in *Antennas: For all Applications*, third edition 2002. The antenna comprises a hollow conductive cylinder with a single narrow rectangular slot formed therein. Generally the slot is longer than $\lambda/2$ at the operating frequency of the antenna. An antenna feed is connected across the small dimension of the slot (identical to the feed arrangement for a conventional slot antenna). In the Kraus description of slotted antennas, the cylinder is shown as a true circular cylinder, however in other references the term cylinder is applied to other cross-section shapes such as a rectangular cross section.

The impedance of the path around the circumference of the cylinder is sufficiently low so that most of the current tends to flow in horizontal loops around the cylinder. If the diameter of the cylinder is a sufficiently small fraction of a wavelength, for example less than about $\lambda/8$, an upright cylinder with a vertical slot radiates a horizontally polarized field with a radiation pattern that is substantially circular in the horizontal plane. As the cylinder diameter increases, the pattern in the horizontal plane tends to become more unidirectional with the maximum radiation from the side of the cylinder where the slot is located.

BRIEF DESCRIPTION OF THE DRAWINGS

The present invention can be more easily understood and the advantages and uses thereof more readily apparent when the following detailed description of the present invention is read in conjunction with the figures wherein.

DETAILED DESCRIPTION OF THE INVENTION

Before describing in detail the exemplary methods and apparatuses related to a slot antenna, it should be observed that the present invention resides primarily in a novel and non-obvious combination of elements and steps. So as not to obscure the disclosure with details that will be readily apparent to those skilled in the art, certain conventional elements and steps have been presented with lesser detail, while the drawings and the specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Antennas constructed according to the teachings of the present invention for use in space-limited platforms offer a significant advantage over prior art antennas due to their increased radiation efficiency. In one embodiment a radiation efficiency in excess of about 45% was measured on the same platform where a conventional PIFA type solution produced a radiation efficiency of only about 15%.

Figure 1:
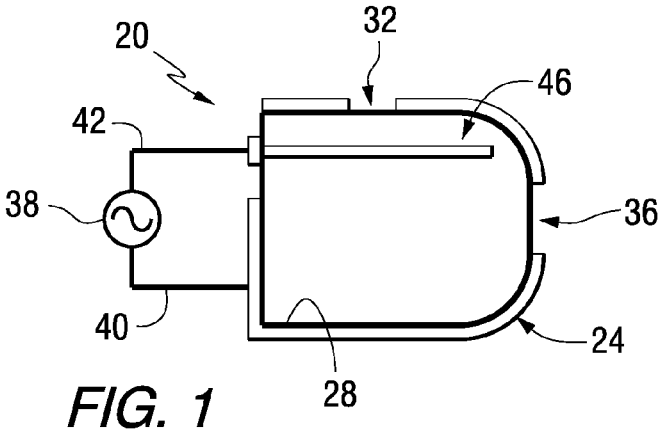
FIGS. 1 and 2 illustrate a cross-sectional view of a slot antenna constructed according to the teachings of the present invention.
Figure 2:
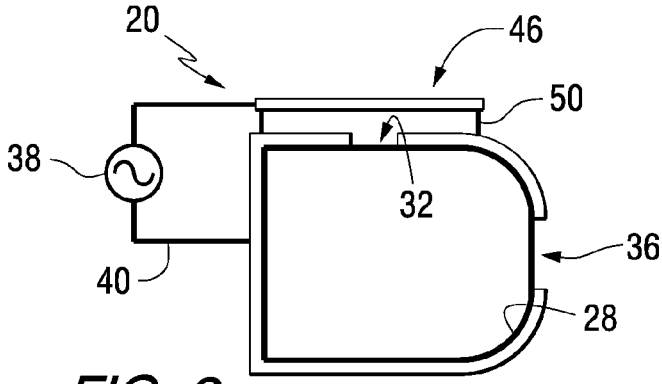

In one embodiment a slotted cylinder antenna 20 of the present invention is in the form of a tubular member having an outer conductive surface 24 disposed on an inner dielectric substrate 28, as shown in the cross-sectional views of FIGS. 1 and 2. These Figures illustrate a D-shaped cross-section, but this is not required for antenna performance. The D-shape was selected for one application to allow the antenna 20 to conform to, optimally utilize and blend with the cosmetics of the allowable space in a hinge gap area, i.e., the space between two hinges, where the hinges also have a D-shaped cross-section. In this application the two hinges are spaced apart and fixedly attached to a laptop computer screen. The hinges are also pivotably attached to a laptop keyboard, permitting the computer screen to pivot relative to the keyboard. Thus when the screen is opened and the antenna is operative, the antenna is disposed between two conductive structures, i.e., a frame surrounding the computer screen and the keyboard. In other applications the slotted cylinder antenna may be disposed between other conductive structures and the tubular member may have a different cross-sectional shape, e.g., circular, rectangular, square or the shape of another geometric figure (all generally referred to as a slotted cylinder antenna). The features of the antenna of the present invention can also be adapted to different platforms.

Referring to FIGS. 1 and 2, the antenna 20 defines a slot 32 having a length of approximately $\lambda/2$ and a width of approximately 1.5 mm (typically the slot width is $<<\lambda$). In a preferred embodiment the slot 32 is formed in the conductive surface 24 but not in the underlying dielectric substrate 28. The antenna 20 is excited proximate the slot using techniques described below (i.e., using a probe) but can also be fed by connecting the antenna feed conductors across the slot as described above in the Background section.

The antenna 20 further defines a narrow gap 36 in the conductive surface 24 (but preferably not within the dielectric substrate 28) that extends a length of the cylinder. In one embodiment the gap width is about 0.5 mm, although other gap widths will allow the antenna to function properly. Generally, as the gap width decreases the antenna resonant frequency declines and the impedance match is affected. The antenna impedance is also influenced by other elements of the antenna, including the dielectric constant of the dielectric substrate 28, the slot length, width and location, the antenna gap width, the probe location relative to the slot, the probe impedance and the probe length.

In one embodiment of a rectangular cross-section antenna constructed according to the teachings of the present invention, the antenna is about 72 mm long, about 6.2 mm tall (thick) and about 8.5 mm wide. The antenna slot is about 30 mm long by about 1.5 mm wide.

On embodiment of the antenna 20 is fed through a coaxial cable from a signal source 38 of a communications device (not shown) operating with the antenna, for example, a laptop computer. A coaxial cable shield 40 conductively connects to a region of the conductive surface 24 (typically on an external surface of the antenna cylinder) and a center feed 42 of the coaxial cable conductively connects to a microstrip probe 46 that extends across the slot 32 (i.e., the probe 46 extends across a smaller (width) dimension of the slot). The probe 46 may be placed proximate the slot 32 either within the interior of the antenna cylinder (FIG. 1) or external to the antenna cylinder (FIG. 2). In the latter case the probe 46 may be supported by a dielectric substrate material 50 disposed over the conductive surface 24.

The antenna does not require electrical connection to any other components (i.e. a ground plane or a counterpoise) to operate effectively, nor is antenna performance significantly degraded by contact with a conductive surface, especially proximate the gap. Thus its performance will not be degraded if the antenna inadvertently contacts a conductive surface or if such contact is required, for example to properly mount the antenna in the communications device, such as a laptop computer. In one embodiment the exposed conductive material of the antenna (i.e., the conductive surface 24) is coated with an insulating material to protect the conductive surface against corrosion.

When located in free space, the antenna produces an omnidirectional pattern about the long axis of the slot (which is parallel to the long axis of antenna) and the far-field polarization is orthogonal to the long axis. When installed in a cavity or opening of a laptop computer 59 (see FIG. 3), the antenna 20 is mounted horizontally in a hinge gap area 60 (between hinges 61) and further bounded by an LCD screen 62 and its supporting elements and a keyboard 64 and its supporting elements. If a radome covering the antenna is removed, the antenna slot 32 is visible to a computer user sitting at the keyboard. As can be seen, the long antenna axis is parallel to the hinge gap axis (a line between the two hinges). Thus the antenna signal polarization is normal to the hinge gap axis as illustrated by an arrowhead 68. Generally, the cavity or opening into which the antenna of the present invention is disposed is an opening or gap between two conductive bodies.

In one design the slot length is approximately half of the guided wavelength, that is, the wavelength of a wave traveling on the slot at an operating frequency of 2.4 GHz. The guided wavelength, which is shorter than the free space wavelength due to the higher dielectric constant of the antenna, is a function of the dielectric constant of the dielectric material within and outside the antenna's cylinder and the slot width. The guided wavelength is approximately equal to $$\lambda_{FREE\ SPACE}/(\mathrm{SQRT}[(\in_{INSIDE\ CYLINDER}+\in_{OUTSIDE\ CYLINDER})/2])$$

where the dielectric constant values are taken to be average values inside and outside the cylinder. As can be seen from the equation, use of a material having a high dielectric constant (greater than about 10, for example) inside the cylinder results in a lower guided wavelength, which in turn allows use of a shorter slot. When space for the antenna is at a premium, a shorter slot length and thus a shorter antenna is advantageous.

Preferably the antenna length (i.e., a length of the cylinder or tubular member) is substantially longer than a half wavelength. The dielectric constant of the material of the cylinder, the length of the slot, the length of the cylinder, the width of the gap running the length of the cylinder, and the length, width and location of the probe serve as design variables to control impedance matching and resonant frequencies of the antenna. The probe serves as an impedance matching element to couple the antenna to a nominal 50 ohm feed. Matching is effected by extending the probe beyond the slot and using this extension as a microwave tuning stub, with the electrical length and characteristic impedance of the stub manipulated by changing the width and length of the extension.

In the desired mode of excitation, the antenna operates as a small loop antenna with the circumference of the cylinder representing the loop. Most of the current therefore flows circumferentially around the antenna cylinder.

The Q is high for this mode of operation and therefore one technique for achieving a wider bandwidth within an operating band of 2400-2500 MHz comprises selecting antenna parameters to create two closely spaced resonant frequencies within the operating band. In particular, the frequency of the resonant antenna modes are dependent on the length of the cylinder and the length of the slot. These two lengths can be adjusted to bring the two resonant frequencies closer at the desired operating frequency to provide increased bandwidth over that available from a single resonant frequency.

Figure 3:
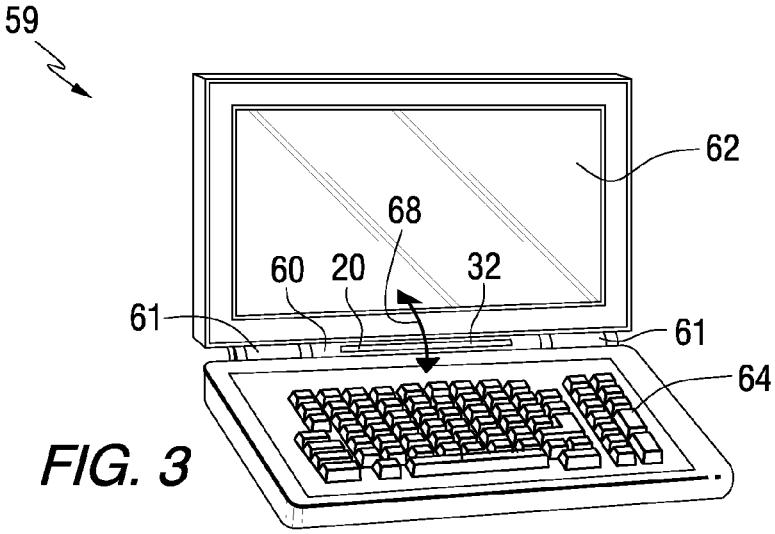
FIG. 3 illustrates a laptop computer showing the approximate location of an antenna of the present invention within the laptop computer.

In the application where the antenna is disposed within the hinge gap (i.e., between the two hinges) between the laptop computer screen and the keyboard (as illustrated in FIG. 3), and given a typical wireless operating frequency for the antenna and a typical laptop size and configuration, the antenna length tends to be shorter than the distance between the two hinges.

Figure 4:
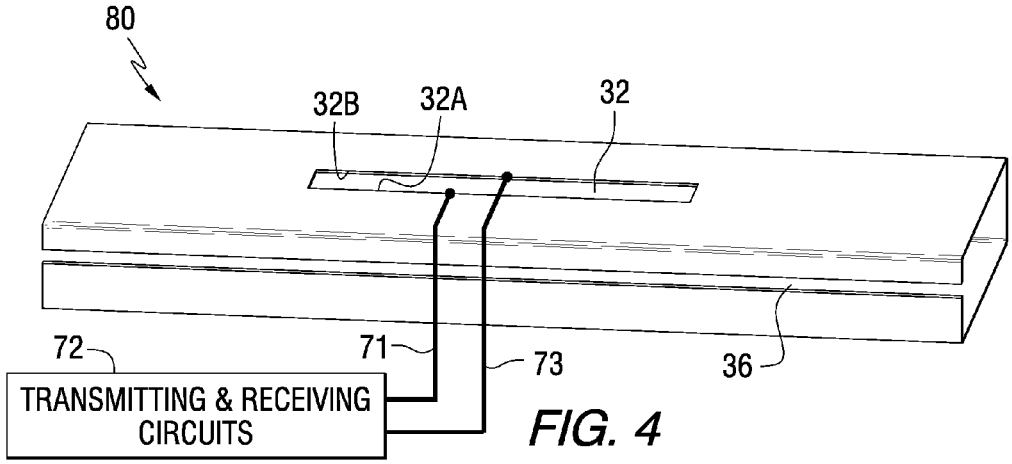
FIGS. 4-6 illustrate other embodiments of slot antennas constructed according to the teachings of the present invention.

FIG. 4 illustrates a slotted antenna 80 constructed according to one embodiment of the present invention. In this embodiment the antenna 80 comprises a substantially rectangular cross section and a feed comprises a first conductor 71 (e.g., a shield of a coaxial cable connected to transmitting and receiving circuits 72) connected to an edge 32A of the slot 32 and a second conductor 73 connected to a second edge 32B parallel to the edge 32A.

Figure 5:
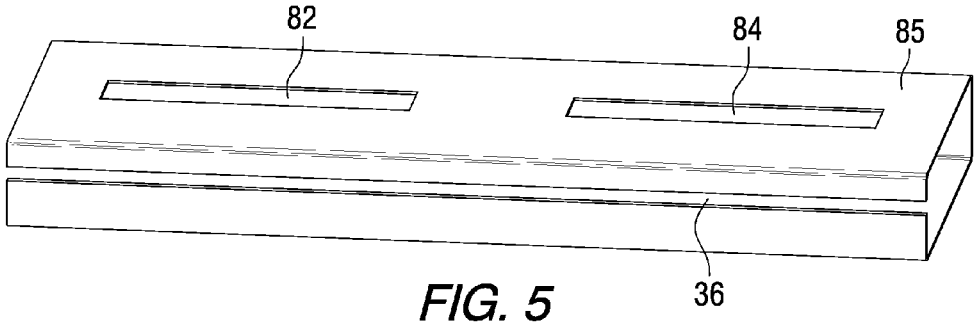

FIG. 5 illustrates dual antennas defined by slots 82 and 84 formed on a single substrate 85, each antenna driven by a separate feed (not shown). The two antennas may be designed to operate at two different frequencies or at the same frequency (providing antenna diversity in the latter case). Each antenna may also be designed to operate at more than a single frequency. Since each of the slots and its respective feed represents an independent antenna, other embodiments comprise more than two slots/feeds and thus more than two antennas operating at the same or at different frequencies.

The WiFi protocol supports and is generally implemented with antenna diversity. For such WiFi applications, the two antennas of FIG. 5 operate at substantially the same resonant frequency (e.g., within the 2.4 to 2.5 GHz band). Thus in this application the FIG. 5 configuration may be referred to as a single band two-antenna diversity configuration.

Figure 6:
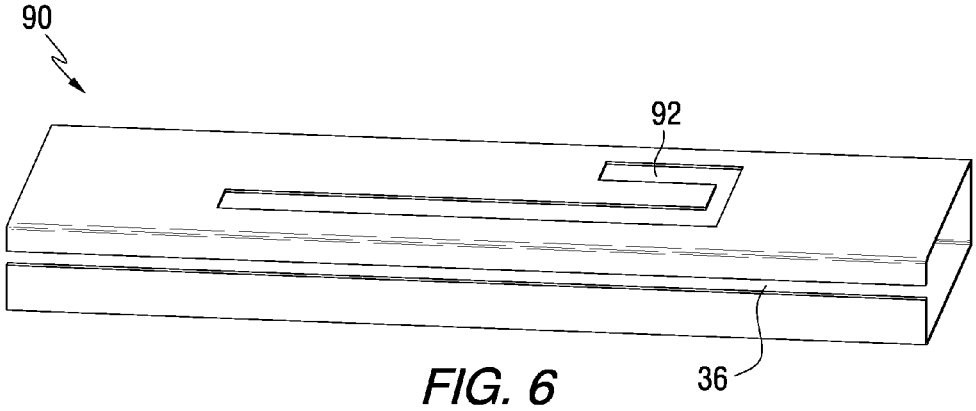

An antenna 90 of FIG. 6 provides dual band operation, for example, in the 2.4 GHz and 5.25 GHz bands. In this embodiment a J-shaped slot 92 offers desired antenna characteristics, including a resonant frequency and impedance matching at the desired dual-band frequencies. The resonance at 5.25 GHz is created by the short leg of the J-shape. Typically, for dual-band operation the antenna comprises only a single probe (not illustrated) crossing a long leg of the J-shaped slot 92.

While the present invention has been described with reference to preferred embodiments, it will be understood by those skilled in the art that various changes may be made and equivalent elements may be substituted for the elements thereof without departing from the scope of the invention. The scope of the present invention further includes any combination of elements from the various described embodiments. In addition, modifications may be made to adapt a particular situation to the teachings of the present invention without departing from its essential scope. Therefore, it is intended that the invention not be limited to the particular embodiments disclosed, but that the invention will include all embodiments falling within the scope of the appended claims.

What is claimed is:

1. An antenna for placement in an opening within a first conductive material, the antenna comprising:

a dielectric tubular member;

a second conductive material forming an exterior surface of the tubular member;

the second conductive material defining a slot therein, the slot having a slot length approximately equal to one-half of a guided wavelength and having a slot width, there being no slot present in the tubular member immediately beneath the slot in the second conductive material, wherein a width of the opening defined by the first conductive material is less than a quarter wavelength of the guided wavelength; and a feed proximate the slot for establishing currents in the second conductive material when the antenna is in a transmitting mode, the currents perpendicular to the slot length.

2. A communications device for sending and receiving an information signal, the communications device comprising:

an element having an opening defined therein for receiving an antenna, the element comprising first conductive material disposed proximate the opening;

transmitting and receiving circuits;

the antenna comprising:

a dielectric tubular member;

second conductive material forming an exterior surface of the tubular member;

the second conductive material defining a slot therein, a slot length approximately equal to one-half of a guided wavelength; and a feed connected to the transmitting and receiving circuits and disposed proximate the slot for establishing currents in the second conductive material when the antenna is in a transmitting mode.

3. The device of claim 2 wherein the currents are perpendicular to the slot length.

4. The device of claim 2 wherein the slot length is substantially greater than a slot width.

5. The device of claim 2 wherein a dielectric constant of the dielectric tubular member is at least 10.

6. The device of claim 2 wherein the antenna comprises a slotted cylinder antenna.

7. The device of claim 2 wherein a width of the opening for receiving the antenna is less than a quarter wavelength at an operating frequency of the antenna.

8. The device of claim 2 wherein the second conductive material further defines a gap therein, the gap extending a length of the tubular member.

9. The device of claim 2 wherein a cross section of the tubular member comprises one of a D-shaped cross-section, a circular cross-section, a rectangular cross-section and a square cross-section.

10. The device of claim 2 wherein the feed comprises a first conductor connected to the second conductive material and a second conductor extending across a width of the slot from a first edge of the slot to a second edge of the slot and connected to the second edge.

11. The device of claim 2 wherein the element having an opening therein comprises a laptop computer screen or a laptop computer keyboard, and wherein a radiation pattern is substantially omnidirectional relative to a long axis of the slot.

12. The device of claim 2 wherein the antenna exhibits two closely spaced resonant frequencies.

13. The device of claim 2 wherein the antenna comprises at least two slots each separately excited.

14. The device of claim 2 wherein the two slots have a substantially equal resonant frequency and provide antenna diversity for the communications device.

15. The device of claim 2 wherein the slot comprises a J-shaped slot.

16. The device of claim 15 wherein the J-shaped slot comprises a short leg having a first resonant frequency and a long leg having a second resonant frequency.

17. The device of claim 2 wherein the feed comprises a microstrip probe mounted proximate the slot.

* * * * *